US007956301B2

(12) United States Patent
Lankuttis et al.

(10) Patent No.: US 7,956,301 B2
(45) Date of Patent: Jun. 7, 2011

(54) TAMPER PROTECTION DEVICE FOR AN ELECTRICAL SWITCHING DEVICE, INCLUDING A PROTECTION CAP AND A RETAINER FOR A SECURITY SEAL

(75) Inventors: Klaus Lankuttis, Bergisch-Gladbach (DE); Claudia Pleikies, Niederkassel (DE)

(73) Assignee: Eaton Industries GmbH, Bonn (DE)

( * ) Notice: Subject to any disclaimer, the term of this patent is extended or adjusted under 35 U.S.C. 154(b) by 332 days.

(21) Appl. No.: 12/099,852

(22) Filed: Apr. 9, 2008

(65) Prior Publication Data

US 2008/0251361 A1 Oct. 16, 2008

(30) Foreign Application Priority Data

Apr. 13, 2007 (DE) ..... 10 2007 017 929

(51) Int. Cl.
*H01H 9/28* (2006.01)

(52) U.S. Cl. ..... 200/43.19; 200/43.01

(58) Field of Classification Search ..... 200/43.19
See application file for complete search history.

(56) References Cited

U.S. PATENT DOCUMENTS 4,467,152 A * 8/1984 Gordy ..... 200/43.21
5,148,910 A * 9/1992 Williams ..... 200/43.19
5,324,897 A * 6/1994 Melgoza et al. ..... 200/43.11
6,512,433 B1 * 1/2003 Bouchard et al. ..... 335/6
6,703,572 B1 * 3/2004 Broghammer ..... 200/43.14

FOREIGN PATENT DOCUMENTS

DE 195 22 049 A1 12/1996
DE 201 16 028 U1 11/2001
DE 600 03 946 T2 2/2004
EP 0371415 6/1990

OTHER PUBLICATIONS

European Search Report of EP 08002416 dated Feb. 1, 2010.

* cited by examiner

*Primary Examiner* — Renne S Luebke
*Assistant Examiner* — Lisa Klaus
(74) *Attorney, Agent, or Firm* — Leydig, Voit & Mayer, Ltd.

(57) ABSTRACT

A tamper protection device for an electrical switching device including a housing and a panel for at least one control element. The tamper protection device a protection cap configured to prevent unwanted operation or tampering of the control element when in position on the housing and a seal retainer configured to block the protection cap from being removed from the covering position when the seal retainer and protection cap are connected by a secured seal wire thereby forming a sealed unit. Each of the protection cap and the seal retainer are releasably connectable to the housing. When the protection cap and seal retainer are secured as the sealed unit it is non-releasably connectable to the housing by an interlocking connection.

19 Claims, 4 Drawing Sheets

Fig. 2
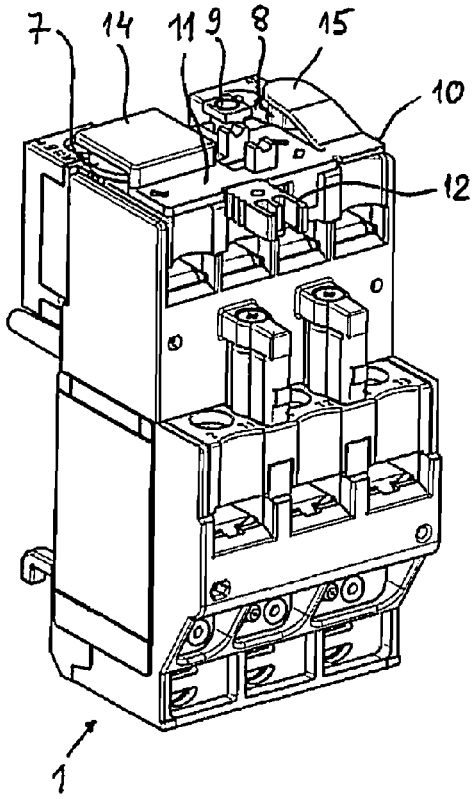
Fig. 1
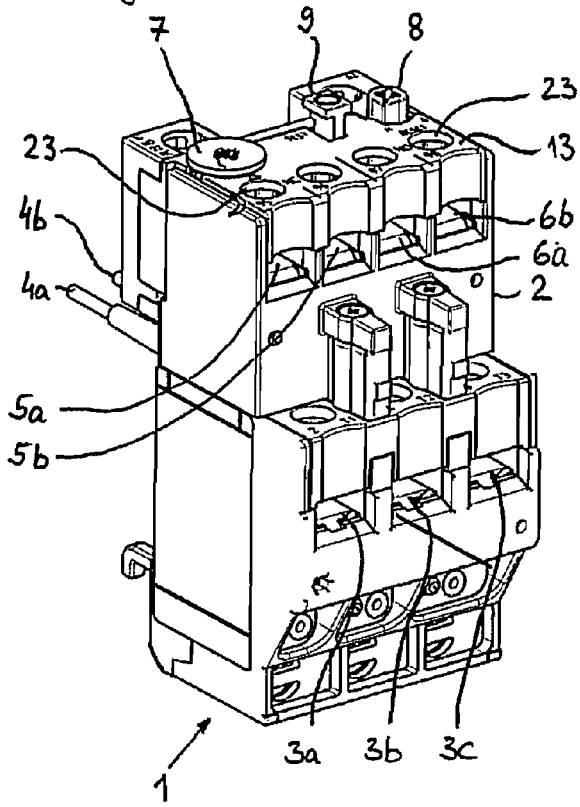
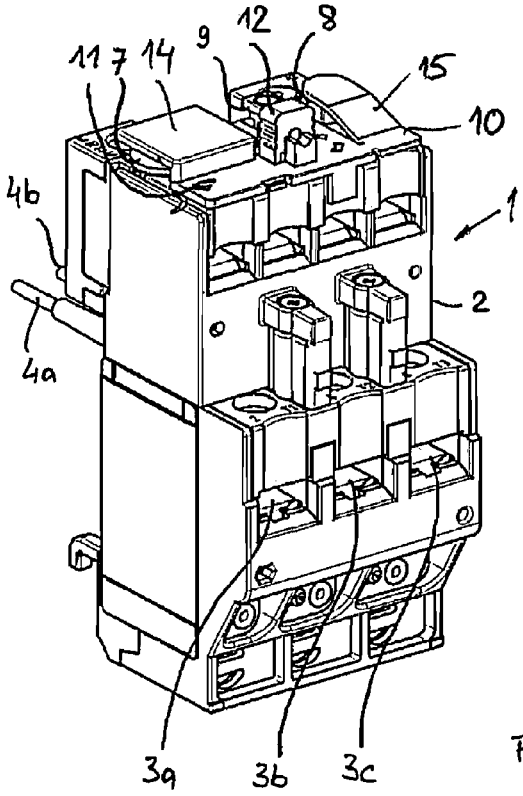
Fig. 3
Fig. 4
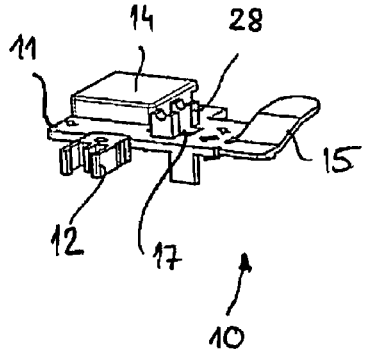

Fig. 7
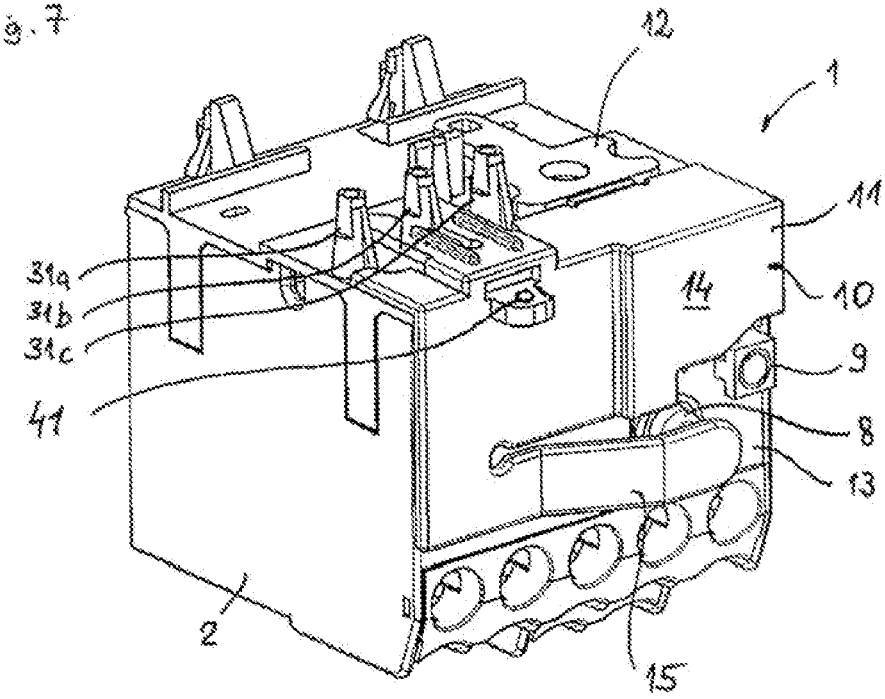
Fig. 8
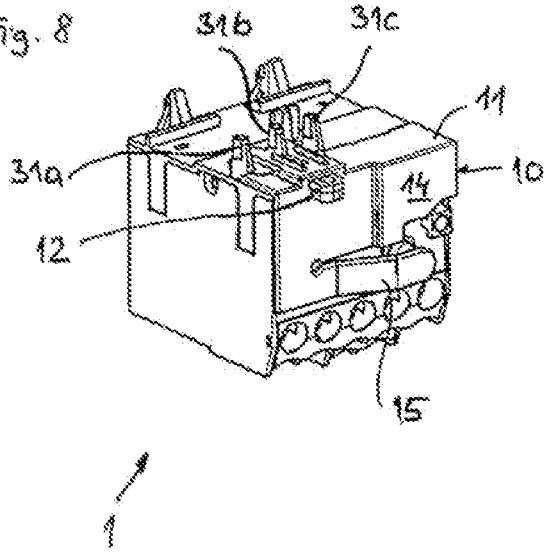
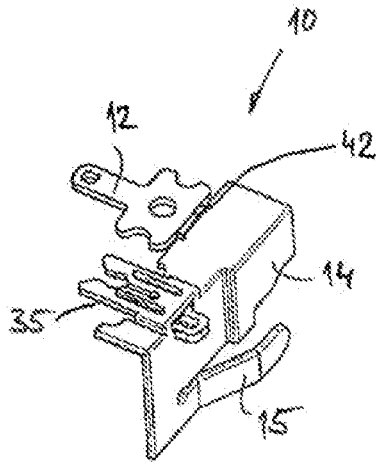
Fig. 9

TAMPER PROTECTION DEVICE FOR AN ELECTRICAL SWITCHING DEVICE, INCLUDING A PROTECTION CAP AND A RETAINER FOR A SECURITY SEAL

CROSS REFERENCE TO RELATED APPLICATIONS

Priority is claimed to German patent application DE 10 2007 017 929.6, filed Apr. 13, 2007, which is hereby incorporated by reference herein.

FIELD

The present invention relates to a tamper protection device which includes a protection cap and a retainer for a security seal and is intended for an electrical switching device, in particular for a protective relay, having a housing and a panel or control panel for switches, rotary knobs, push buttons, or the like. The present invention further relates to an electrical switching device that is equipped with a tamper protection device.

BACKGROUND

European Patent Document EP 0 371 415 B1 describes a protective relay which is in the form of a thermal overcurrent relay or overload protection relay and is used as a reliable means of protection in overload and phase-failure conditions caused by disconnection of an electrical load, such as an electric motor. In accordance with EP 0 371 415 B1, the essential components of such a thermal protection relay are a bimetal trip element, a transmission mechanism, and an auxiliary switch. In the event of motor overload or phase failure, the bimetal trip element actuates a lever, the movement of which is transmitted by the transmission mechanism to the auxiliary switch. This causes the auxiliary switch to change position. In this manner, the motor is de-energized when exposed to damage and, in addition, the switching state may optionally be signaled via the contacts of the auxiliary switch.

The protective relay of EP 0 371 415 B1 has a current-setting dial which allows the protective relay to be set to different rated motor current values. After an overload trip, the protective relay can be reset either automatically or manually; a push button being provided for selecting between the modes "automatic" and "manual". In order to manually reset the protective relay after an overload trip, there is provided a reset button which is combined with the mode selection button. Also provided is an OFF/TEST button.

In commercially available protective relays (such as the Siemens Sirius 3R), a protection cap is used to prevent unwanted operation of the current-setting dial and mode selection button. This protection cap is movable and, when in a covering position, covers the current-setting dial and mode selection button, thereby preventing operation of these controls. In order to secure the protection cap in the covering position, or to be able to detect unwanted tampering with the protective relay, a retainer for a security seal is formed integrally with a housing of the protective relay. The seal retainer includes an eye through which a seal wire can be passed. When the protection cap is in the covering position, this eye is in alignment with an eye formed in the protection cap. Once the seal wire is passed through the two eyes and secured by a security seal, the protection cap can no longer be removed from the covering position.

Although in many applications, it is desired to have a tamper protection device including a protection cap and a seal retainer, there is a need for protective relays which are simple and inexpensive in construction and which do not have a tamper protection device. This leads to a multitude of protective relays which differ in construction, resulting in increased manufacturing and handling costs to a supplier of protective relays.

SUMMARY

It is an aspect of the present invention to provide a tamper protection device for switching devices, in particular for protective relays, that will have the minimum possible impact on costs if the intention is to offer protective relays of different configurations.

In an embodiment, the present invention provides a tamper protection device for an electrical switching device including a housing and a panel for at least one control element. The tamper protection device a protection cap configured to prevent unwanted operation or tampering of the control element when in position on the housing and a seal retainer configured to block the protection cap from being removed from the covering position when the seal retainer and protection cap are connected by a secured seal wire thereby forming a sealed unit. The protection cap and the seal retainer are each releasably connectable to the housing. When the protection cap and seal retainer are secured as the sealed unit it is non-releasably connectable to the housing by an interlocking connection.

BRIEF DESCRIPTION OF THE DRAWINGS

The present invention will now be explained in more detail with reference to exemplary embodiments illustrated in the drawings, in which:

FIG. 1 is a perspective view showing a protective relay;

FIG. 2 shows the protective relay of FIG. 1 along with a tamper protection device including a protection cap and a seal retainer;

FIG. 3 is a view of the protective relay of FIGS. 1 and 2, showing the seal retainer in the inserted position;

FIG. 4 is a perspective view of the tamper protection device shown in FIG. 2;

FIG. 7 is a view showing a further embodiment of the protective relay and the tamper protection device;

FIG. 8 is a view of the protective relay of FIG. 7, showing the seal retainer in the inserted position;

FIG. 9 is a perspective view of the tamper protection device shown in FIG. 7;

DETAILED DESCRIPTION

Figure 6:
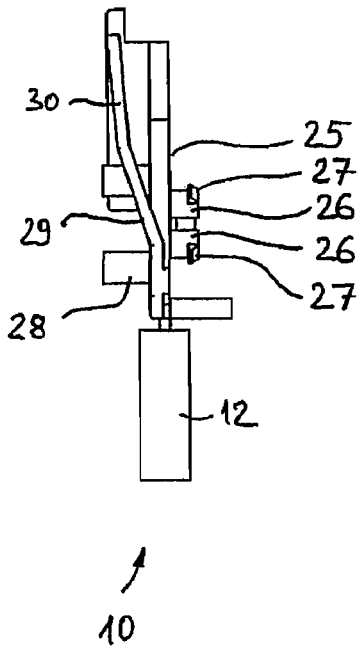
FIG. 6 is a side view of the tamper protection device of FIG. 4.

In an embodiment, a feature of the tamper protection device of the present invention is that the protection cap and the seal retainer are each releasably connectable to the housing of the electrical switching device or protective relay, and that the sealed unit formed of the protection cap and the seal retainer is non-releasably connectable to the housing by an interlocking connection. Accordingly, the releasable connection of the protection cap and the releasable connection of the seal retainer can be transformed into a non-releasable connection by connecting the protection cap and the seal retainer together by the seal wire. In that case, the unit is sealed and can no longer be removed from the housing without breaking the wire, which may be secured by a seal. It is also not possible to remove the protection cap from its covering position, because the seal would thereby be destroyed. In an embodiment, the present invention makes it possible to produce switching devices of identical design in large numbers, and to attach the tamper protection device to the switching device as required without making any modifications thereto. This allows existing switching devices to be retrofitted with the tamper protection device of the present invention.

In should be noted that other sealing devices (such as seal pins, etc.) may be used in place of the seal wire. Also, the housing may include a plurality of housing parts; the sealed unit being connected to at least one of said housing parts by a form-locking and non-releasable connection (as long as the seal wire remains intact). The panel for the manually operable controls may, for example, be a housing part.

In an embodiment, the seal retainer and/or the protection cap can include an enclosed eye. In one embodiment in which the seal retainer and the protection cap each have an enclosed eye, the eyes may be brought into coincidence, allowing the seal wire to be passed through the then aligned openings without difficulty. When the eyes are in this position relative to each other, the protection cap is preferably in its covering position.

The seal retainer and the protection cap do not necessarily have to have an enclosed eye. For example, it may be sufficient to provide an enclosed eye only in the seal retainer. In that case, the seal retainer and the protection cap must cooperate in a manner so as to prevent the seal retainer and the protection cap from being separated from each other once the seal wire is passed through the eye of the seal retainer. The same applies analogously to an embodiment in which only the protection cap has an enclosed eye.

In an embodiment, the protection cap can be inserted onto the housing. In this process, snap-fitting devices may engage with each other, thereby creating a latching or snap-fit connection between the housing and the protection cap. In addition or alternatively, the seal retainer may preferably be inserted or pushed onto the housing. In order to release the protection cap or the seal retainer, which, in accordance with the present invention, can be done as long as the protection cap and the seal retainer are not connected to each other by the seal wire, the housing does not need to be unscrewed or changed in any other way (permanently deformed, destroyed, etc.).

The protection cap can have at least one tab which is provided with a latching nose to engage behind an edge of an opening or behind an edge of the housing when the protection cap is in the covering position. This allows a snap-fit connection to be created between the protection cap and the housing, this snap-fit connection being designed such that it can be non-destructively released by the application of a certain force.

In an embodiment, the seal retainer is formed integrally with the protection cap. The seal retainer can be linked to the protection cap by a breaking joint, so that the seal retainer can be separated from the protection cap with little force and without much difficulty. Since the seal retainer and the protection cap are integrally formed as a single piece, they can be manufactured in a mold in a single step and, for the same reason, neither of the two components can be lost.

The protection cap and the seal retainer can also be formed as an injection-molded plastic part. The plastic may be transparent, so that the individual switches, rotary knobs, or the like, which are covered by the protection cap are visible and may be read externally.

The protection cap may include a plurality of portions, at least one of which is formed as a flexible tongue to cover a control element, for example, a mode selection button. The tongue may cover the control element in a manner that will prevent the control element from being rotated by a screwdriver placed on it from above, but will allow it to be depressed by the elastic tongue.

As already mentioned, the protection cap may include a plurality of portions so as to permit optimum adaptation to the configuration of the housing or of the panel for the switches. For example, the protection cap may have a raised portion to provide space therebelow for a raised or relatively thick control element, in particular a current-setting dial. Also, the protection cap may have openings or recesses allowing selected switches within the panel or control panel to be operated manually or by a tool (such as a screwdriver) even when the protection cap is in the covering position.

In an embodiment, the seal retainer is configured as an essentially U-shaped or V-shaped clip having a first leg and a second leg joined by base portion. The free ends of the legs may each be provided with a latching nose which, when in the inserted position, engages behind an edge of an opening or behind an edge of the housing. Thus, a snap-fit connection can be created between the seal retainer and the housing.

If the seal retainer is configured as a U-shaped or V-shaped clip, the protection cap may have formed therein an opening bounded by an edge. When the seal retainer is in the inserted position and the protection cap is in the covering position, the seal retainer extends through the aforesaid opening and the edge of said opening bears against the legs of the seal retainer. When the seal retainer of this embodiment is in the inserted position, the latching noses of the legs engage behind the housing, making it difficult to release them from said engagement because the edge of the opening in which the clip is located prevents the legs from being moved in a manner which would release the connection. Thus, the seal retainer which takes the form of a clip and has legs which are restrained in their movement provides an interlocking connection with the housing, the protection cap preventing said connection from being released. Due to the sealed wire, the protection cap itself is difficult to displace or remove from the seal retainer.

In another embodiment, the seal retainer may have at least one opening or recess which provides an undercut allowing an interlock to be created between the seal retainer and the housing in a first direction, the protection cap having means allowing an interlock with the housing to be created in a second direction different from the first direction. Once the protection cap and the seal retainer are connected to each other by the seal wire, the interlock in the first direction prevents the interlock in the second direction from being released, and vice versa.

The device permitting creation of an interlock may include a projection formed on the protection cap for insertion into a correspondingly shaped opening in the housing. Once the projection is inserted in the opening, an interlock is provided in the directions perpendicular to the insertion direction.

FIG. 1 shows a protective relay, which is denoted in its entirety by reference numeral 1. Protective relay 1 has a multi-part housing 2. Individual housing parts are joined together by snap-fit connections. For connection to a main circuit, protective relay 1 has three screw terminals 3*a*, 3*b*, 3*c* and three terminal pins, of which only two terminal pins 4*a*, 4*b* are shown in FIG. 1. Thus, the protective relay can be connected to a three-phase load, such as an electric motor.

In the event of an overload or phase-failure, the motor current will increase above a preset rated motor current value. This increase in current causes bimetallic strips located within housing 2 to be deflected, so that they will operate an auxiliary switch via a transmission mechanism disposed in housing 2. In the event of an overload, this auxiliary switch, which is also disposed within housing 2, disconnects the motor via a motor contactor. In order to connect the auxiliary switch to the motor contactor or to control devices, the protective relay has four terminals, namely two screw terminals 5*a*, 5*b* for a break contact element of the auxiliary switch and two screw terminals 6*a*, 6*b* for a make contact element of the auxiliary switch.

A current-setting dial 7 allows protective relay 1 to be easily set to a certain rated motor current value. In addition to current-setting dial 7, protective relay 1 includes two further control elements: first, a mode selection button 8 is provided which can be rotated to select "automatic restart" or "manual reset" for cases where protective relay 1 has tripped in response to a motor overload condition. By pressing mode selection button 8, protective relay 1 can be manually reset after it has tripped. Thus, mode selection button 8 combines two functions, namely selection of the mode (automatic, manual) and manual resetting after a trip. In the following, mode selection button 8 is referred to by the shorter term "reset button", although it may also be used for mode selection.

Secondly, an OFF/TEST button 9 is provided which can be used to disconnect the motor contactor and to test the proper functioning of the auxiliary switch.

FIG. 2 shows the protective relay of FIG. 1 in a view in which a tamper protection device 10 covers current-setting dial 7 and reset button 8. Tamper protection device 10 includes a protection cap 11 and a seal retainer 12 which is formed integrally with protection cap 11 and projects laterally therefrom, as is shown in FIG. 2.

Protection cap 11 is substantially flat and, when in a covering position as shown in FIG. 2, covers a front housing part or control panel 13 which accommodates current-setting dial 7 and buttons 8, 9 (see FIG. 1). Control panel 13 has a flat configuration; current-setting dial 7 and buttons 8, 9 projecting from this plane. In order to cover current-setting dial 7, protection cap 11 has a raised portion 14 which is rectangular in shape. In order to cover reset button 8, a tongue 15 is provided which, when protection cap 11 is in the covering position (see FIG. 2), allows reset button 8 to be depressed, but prevents it from being rotated.

Figure 5:
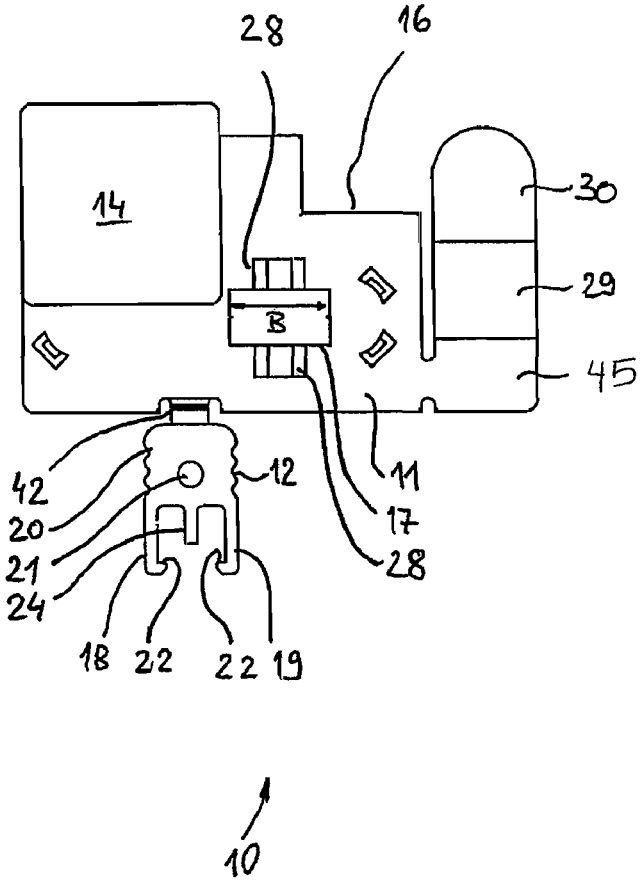
FIG. 5 is a frontal view of the tamper protection device of FIG. 4.

FIGS. 4 through 6 show tamper protection device 10 without protective relay 1. While FIG. 4 shows tamper protection device 10 in a perspective view, FIG. 5 is a frontal view, and FIG. 6 is a side view. FIG. 5 shows particularly well that protection cap 11 has a recess 16 which allows OFF/TEST button 9 to be operated in an unhindered manner even when protection cap 11 is in the covering position.

Seal retainer 12 is linked to protection cap 11 by a breaking joint 42. Breaking joint 42 allows seal retainer 12 to be detached without much force. In FIG. 2 and FIGS. 4 through 6, seal retainer 12 is in a position in which it does not perform the function it is designed for. It performs its intended function when in an inserted position, such as is illustrated in FIG. 3. When in the inserted position, the seal retainer 12 is connected to housing part 13 and extends through a rectangular opening 17 in protection cap 11 (see, in particular, FIG. 5).

For connection to the control panel or to upper housing part 13, seal retainer 12 has a first leg 18 and a second leg 19 joined by base portion 20. Base portion 20 has an enclosed eye 21 through which a seal wire can be passed. Eye 21 is circular in shape and has a diameter of about 2 mm. The free ends of legs 18, 19 are each provided with inwardly directed latching noses 22 which engage behind housing part 13 when seal retainer 12 is in the inserted position. In this position, legs 18, 19 extend through two central passages 23 of a total of four circular openings or passages 23 in upper housing part 13 (see FIG. 1). These passages accommodate the screws used to tighten screw terminals 5*a*, 5*b*, 6*a*, 6*b*. Latching noses 22 engage behind a peripheral edge at the upper end of openings 23.

When seal retainer 12 is in the inserted position, a spacer 24 located between first leg 18 and second leg 19 rests on upper housing part 13, thus preventing legs 18, 19 of seal retainer 12 from being inserted too deep into openings 23.

Protection cap 11 can be connected to housing part 13 in a similar manner as seal retainer 12. A plurality of tabs 26 project from the back side 25 of protection cap 11, said tabs each being provided with a latching nose 27 at a free end thereof. Tabs 26 and their latching noses 27 together serve to clip protection cap 11 into opening 23 of upper housing part 13. Here too, latching noses 27 engage behind the aforementioned peripheral edge at the upper end of the respective opening 23. Four of the plurality of tabs 26 form a group of four. The tabs of this group of four are arranged on a circle at intervals of 90 degrees in the circumferential direction, with the latching noses 27 pointing radially outward. The group of four can then be pressed into one of openings 23.

Tongue 15 of protection cap 11 includes a foot 45 which integrally connects the tongue to the remaining parts of the protection cap. Adjacent to foot 45 is a cranked central portion 29 which carries a rounded tongue tip 30. Due to the cranked configuration of central portion 29, tongue tip 30 is located at a higher level so that it can cover reset button 8 from above. Tongue 15 and the connection between foot 45 and the remainder of protection cap 11 are designed to allow tongue tip 30 to be slightly depressed. However, it is not possible to produce a bending movement in a sideward direction (i.e., in a direction transverse to the longitudinal extension of tongue 15), so that reset button 8 cannot be rotated from above by a Phillips screwdriver.

To obtain a constellation of seal retainer 12 and protection cap 11 such as is shown in FIG. 3, first, seal retainer 12 must be clipped by its latching noses 22 into the central two openings 23. Then, protection cap 11 is mounted from above, in which process base 20 of seal retainer 12 is first passed through opening 17 of protection cap 11, and then protection cap 11 and upper housing part 13 are clipped together by means of tabs 26 and their latching noses 27. Width B of opening 17 (see FIG. 5) is equal to the width of seal retainer 12, so that when latching noses 22 are in the engaged position, the outer surfaces of legs 18, 19 bear against the inner edge of opening 17. When a seal wire is now pulled through eye 21 of seal retainer 12 and secured by a security seal, then, first of all, protection cap 11 can no longer be removed from the protective relay, because two abutment members 28 disposed at the side of opening 17 abut against the seal wire which has been passed through eye 21. Secondly, when seal retainer 12 is in the inserted position, it cannot be removed upwardly, because legs 18, 19 fit closely in opening 17 and are therefore unable to flex outwardly to release the snap-fit connection between seal retainer 12 and upper housing part 13. Thus, the sealed unit formed of seal retainer 12 and protection cap 11 can no longer be removed from protective relay 1. Similarly, when the unit is secured by the seal, it is no longer possible to rotate current-setting dial 7 or reset button 8. It is also no longer possible to unscrew the screws located in openings 23, so that the connection or wiring between protective relay 1 and the motor contactor is also protected.

FIGS. 7 and 8 show another embodiment of a protective relay that interacts with a suitably adapted tamper protection device. Further details of the tamper protection device shown in FIGS. 7 and 8 are illustrated in the different views of FIGS. 9 through 11. In FIGS. 7 through 11, components that are identical, similar, or functionally equivalent to those in FIGS. 1 through 6 are assigned the same reference numerals. Thus, for example, the protective relay shown in FIGS. 7 and 8 is also denoted by 1, and the tamper protection device is also denoted by 10. The following description of FIGS. 7 through 11 will focus on the differences from the embodiment of FIGS. 1 through 6. With regard to common features, reference is made to the above explanations.

FIG. 7 corresponds to FIG. 2 in that it also shows tamper protection device 10 with a seal retainer 12 that is not in its intended insertion position in which protection cap 11 may be secured in the covering position by a seal wire. Rather, seal retainer 12 bears inwardly against a side wall of protective relay 1 in a useless condition, without impairing the operation of protective relay 1 or its wiring. In the first embodiment, too, the position of seal retainer 12 is selected such that the screws for screw terminals 3*a*, 3*b* remain accessible (see FIG. 2).

Figure 10:
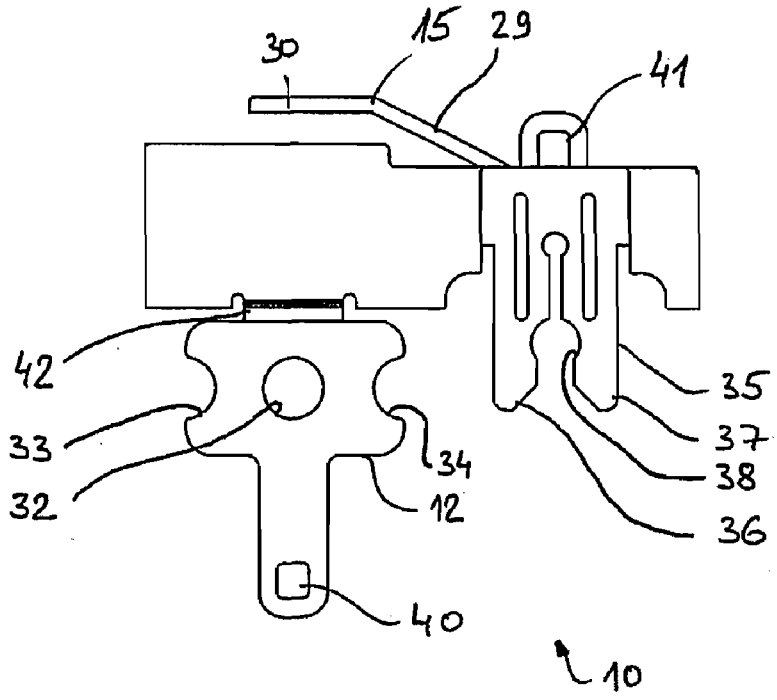
FIG. 10 is a frontal view of the tamper protection device of FIG. 9.
Figure 11:
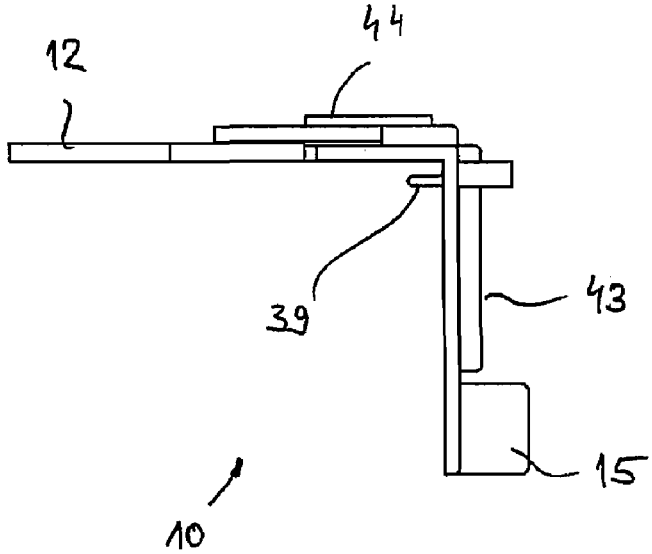
FIG. 11 is a side view of the tamper protection device of FIG. 9.

In order to bring seal retainer 12 to the inserted position shown in FIG. 8, seal retainer 12 is separated from protection cap 11 (see FIG. 9 through 11, which show tamper protection device 10 without the protective relay). Due to breaking joint 42, this can be easily accomplished without much force.

In order to obtain the inserted position, seal retainer 12 is placed from above onto tapered sockets 31*a*, 31*b*, 31*c* of the terminal pins (not shown here), in which process central socket 31*b* engages in a circular opening 32 in seal retainer 12. In addition, an edge of a semicircular recess 33 abuts against socket 31*a*, and an edge of a semicircular recess 34 abuts against socket 31*c*. In this manner, an interlock is created between seal retainer 12 and protective relay 1 in a direction transverse to the direction of insertion, i.e., transverse to the longitudinal extension of tapered sockets 31*a*, 31*b*, and 31*c*.

In a further step, protection cap 11 is then pushed from the side onto sockets 31*a* through 31*c*, in particular onto socket 31*b*. Protection cap 11 includes a clip 35 having two legs 36, 37 which are spaced apart, and each of which is formed with a slight undercut 38 on its inner side. When pushing clip 35 onto central socket 31*b*, legs 36, 37 are urged apart. Once undercuts 38 have passed socket 31*b*, the legs flex back to their original position. In the process, protection cap 11 assumes the covering position in which projection 39 engages in a correspondingly shaped slot in housing 2 of protective relay 1 (see FIG. 11). Due to the position of projection 39 in the slot of housing 2, protection cap 11 cannot be moved in a longitudinal direction of sockets 31. Thus, protection cap 11 can indeed be released against the resilience of the legs 36, 37, but not be moved in a direction perpendicular thereto, and especially not in an upward direction.

In the covering position, an eye 40 of seal retainer 12 and an eye 41 formed on protection cap 11 are located one above the other, so that a seal wire can be passed through the two openings 40, 41. In this position, clip 35 lies flat on seal retainer 12. The seal wire converts protection cap 11 and seal retainer 12 into one unit which can neither be moved in an upward direction (because of projection 39), nor sideways (because opening 32 embraces socket 31*b*). Thus, the unit is non-releasably attached to housing 2 of protective relay 1 by an interlocking connection. Protection cap 11 can only be removed by damaging the seal wire, protection cap 11, or seal retainer 12.

While the protection cap of the first embodiment is substantially flat, protection cap 11 of FIGS. 7 through 11 has two portions 43, 44 which are perpendicular to each other. This can be seen particularly well in FIG. 11, in which protection cap 11 is shown in a side view. Portion 43 serves to cover buttons 7, 8, while portion 44 rests on top of protective relay 1 and, due to the corner between portions 43, 44, adds stability to the protection cap.

LIST OF REFERENCE NUMERALS

1 protective relay
2 housing
3 screw terminal (3*a*, 3*b*, 3*c*)
4 terminal pin (4*a*, 4*b*)
5 screw terminal (5*a*, 5*b*)
6 screw terminal (6*a*, 6*b*)
7 current-setting dial
8 reset button
9 OFF/TEST button
10 tamper protection device
11 protection cap
12 seal retainer
13 front housing part (control panel)
14 raised portion
15 tongue
16 recess
17 opening
18 first leg
19 second leg
20 base portion
21 eye
22 latching nose
23 opening
24 spacer
25 back side
26 tab
27 latching nose
28 tongue foot
29 central portion
30 tongue tip
31 socket (31*a*, 31*b*, 31*c*)
32 opening
33 recess
34 recess
35 clip
36 leg
37 leg
38 undercut
39 projection
40 eye
41 eye
42 breaking joint
43 portion
44 portion
B width

What is claimed is:

1. A tamper protection device for an electrical switching device including a housing and a panel for at least one control element, the tamper protection device comprising:

a protection cap configured to prevent unwanted operation or tampering of the at least one control element when in a covering position on the housing; and a seal retainer configured to block the protection cap from being removed from the covering position when the seal retainer and protection cap are connected by a secured seal device so as to form a sealed unit, wherein the protection cap and the seal retainer are each releasably connectable to the housing, wherein the seal retainer is linked to the protection cap by a breaking joint, and wherein the sealed unit of the protection cap and seal retainer is non-releasably connectable to the housing by an interlocking connection.

2. The tamper protection device as recited in claim 1, wherein the electrical switching device includes a protective relay.

3. The tamper protection device as recited in claim 2, wherein at least one of the seal retainer and protection cap include an enclosed eye.

4. The tamper protection device as recited in claim 2, where the protection cap is insertable in the housing.

5. The tamper protection device as recited in claim 1, wherein seal device is a seal wire.

6. The tamper protection device as recited in claim 1, wherein at least one of the seal retainer and protection cap include an enclosed eye.

7. The tamper protection device as recited in claim 6, wherein the protection cap includes at least one tab having a latching nose configured to engage behind at least one of an edge of the housing and an edge of an opening of the housing when the protection cap is in the covering position.

8. The tamper protection device as recited in claim 1, wherein the protection cap is insertable in the housing.

9. The tamper protection device as recited in claim 1, wherein the protection cap includes a plurality of portions, at least one of the portions being formed as a flexible tongue configured to cover a control element.

10. The tamper protection device as recited in claim 1, wherein the protection cap has at least one recess configured to accommodate an accessible control element.

11. A tamper protection device for an electrical switching device including a housing and a panel for at least one control element, the tamper protection device comprising:

a protection cap configured to prevent unwanted operation or tampering of the at least one control element when in a covering position on the housing; and a seal retainer configured to block the protection cap from being removed from the covering position when the seal retainer and protection cap are connected by a secured seal device so as to form a sealed unit, wherein the protection cap and the seal retainer are each releasable connectable to the housing, wherein the sealed unit of the protection cap and seal retainer is non-releasably connectable to the housing by an interlocking connection, and wherein the seal retainer is formed integrally with the protection cap.

12. A tamper protection device for an electrical switching device including a housing and a panel for at least one control element, the tamper protection device comprising:

a protection cap configured to prevent unwanted operation or tampering of the at least one control element when in a covering position on the housing; and a seal retainer configured to block the protection cap from being removed from the covering position when the seal retainer and protection cap are connected by a secured seal device so as to form a scaled unit, wherein the protection cap and the seal retainer are each releasably connectable to the housing, wherein the sealed unit of the protection cap and seal retainer is non-releasably connectable to the housing by an interlocking connection, and wherein the seal retainer is configured as a substantially U-shaped or V-shaped clip having a first leg and a second leg joined by a base portion, each leg having a free end including a latching nose which, when in the inserted position, engages behind at least one of an edge of the housing and an edge of an opening of the housing.

13. The tamper protection device as recited in claim 12, wherein the protection cap includes an opening bounded by an edge, and when the seal retainer is in the inserted position and the protection cap is in the covering position, the seal retainer extends through the opening and the edge of said opening bears against the legs of the seal retainer.

14. A tamper protection device for an electrical switching device including a housing and a panel for at least one control element, the tamper protection device comprising:

a protection cap configured to prevent unwanted operation or tampering of the at least one control element when in a covering position on the housing; and a seal retainer configured to block the protection cap from being removed from the covering position when the seal retainer and protection cap are connected by a secured seal device so as to form a sealed unit, wherein the protection cap and the seal retainer are each releasably connectable to the housing, wherein the sealed unit of the protection cap and seal retainer is non-releasably connectable to the housing by an interlocking connection, wherein the seal retainer has at least one opening or recess including an undercut operable to provide an interlock between the seal retainer and the housing in a first direction, and wherein the protection cap has an interlock device operable to interlock the protection cap with the housing with respect to a second direction different from the first direction.

15. The tamper protection device as recited in claim 14, wherein the interlock device includes a projection formed on the protection cap configured for insertion into a correspondingly shaped opening in the housing.

16. An electrical switching device comprising:

a housing;

a panel for at least one control element; and a tamper protection device comprising:

a protection cap configured to prevent unwanted operation or tampering of the at least one control element when in a covering position on the housing; and a seal retainer configured to block the protection cap from being removed from the covering position when the seal retainer and protection cap are connected by a secured seal device so as to form a sealed unit, wherein the protection cap and the seal retainer are each releasably connectable to the housing, wherein the seal retainer is linked to the protection cap by a breaking joint, and wherein the sealed unit of the protection cap and seal retainer is non-releasably connectable to the housing by an interlocking connection.

17. The electrical switching device recited in claim 16 further comprising a protective relay.

18. The electrical switching device as recited in claim 16, wherein the seal device is a seal wire.

19. The electrical switching device as recited in claim 16, wherein at least one of the seal retainer and protection cap include an enclosed eye.

* * * * *